United States Patent [19]

Agers et al.

[11] 4,096,612

[45] Jun. 27, 1978

[54] JET FOR FLUID TEXTURING YARN

[75] Inventors: Brian Michael Agers, Wilmington, Del.; Maurice Cornelius Todd, Glen Mills, Pa.

[73] Assignee: E. I. Du Pont de Nemours and Company, Wilmington, Del.

[21] Appl. No.: 731,982

[22] Filed: Oct. 13, 1976

[51] Int. Cl.[2] ..... D02G 1/16

[52] U.S. Cl. ..... 28/272; 28/254; 28/273

[58] Field of Search ..... 28/1.4, 72.12, 254, 28/273, 272

[56] References Cited

U.S. PATENT DOCUMENTS

| | | | |
|---|---|---|---|
| Re. 28,090 | 7/1974 | Gluntz | 28/273 |
| 3,125,793 | 3/1964 | Gonsalves | 28/275 |
| 3,345,809 | 10/1968 | Gemeinhardt et al. | 57/22 |
| 3,823,450 | 7/1974 | Ankudowicz et al. | 28/1.4 |
| 3,863,309 | 2/1975 | Price | 28/1.4 |
| 3,881,231 | 5/1975 | Price et al. | 28/1.4 |
| 3,881,232 | 5/1975 | Price et al. | 28/1.4 |
| 3,892,020 | 7/1975 | Koslowski | 28/1.4 X |
| 3,969,799 | 7/1976 | Polney | 28/273 |
| 3,979,805 | 9/1976 | Hoffsommer et al. | 28/1.4 |
| 4,041,583 | 8/1977 | Hart et al. | 28/272 X |

FOREIGN PATENT DOCUMENTS

| | | | |
|---|---|---|---|
| 664,906 | 6/1963 | Canada | 28/273 |

OTHER PUBLICATIONS

Binder, R. C.; Fluid Mechanics, N.Y., Prentice Hall, Inc., 1950, pp. 104–107.

Heat Transfer and Fluid Flow, Data Book, N.Y., General Electric, 1970, pp. 1–6.

*Primary Examiner*—Robert R. Mackey

[57] ABSTRACT

A self-stringing jet device for fluid texturing of yarn has a yarn needle mounted in the jet body through which yarn passes to the outlet end of the jet. There is a high efficiency venturi located in the passage of the yarn needle to facilitate stringup.

8 Claims, 5 Drawing Figures

JET FOR FLUID TEXTURING YARN

BACKGROUND OF THE INVENTION

This invention relates to air texturing of yarn and, more particularly, to improvements in a fluid jet apparatus used to texture the yarn.

Fluid jet apparatus for texturing yarn usually comprises a conically-tipped yarn guiding tube or needle for introducing yarn into the apparatus, a port for supplying pressurized fluid to a space surrounding the forward end of the needle and a nozzle having a conical entrance through which yarn and fluid leave the jet. Yarn is usually introduced into such a jet by moving the forward end of the yarn needle close to the converging entrance of the nozzle or vice-versa so that the flow of pressurized fluid is severely throttled between the two, producing an air pressure less than atmospheric at the forward end of the needle. This induces an inward flow of atmospheric air through the needle which will stringup the jet (i.e., draw an end of yarn into and through the jet). Although jets of this nature are generally satisfactory, stringup of fine denier yarns which have been wetted prior to texturing has been found to be difficult because the velocity of air through the needle is not sufficient to consistently overcome the drag on the filaments clinging to the walls of the yarn passages.

SUMMARY OF THE INVENTION

It has now been found that a jet apparatus for fluid texturing yarn can be made easily stringable when using wet yarns by incorporating a high efficiency venturi in the passage of the yarn needle to provide greater aspiration and higher velocities than previously experienced during stringup with prior art jet apparatus.

The yarn texturing jet includes a body having yarn inlet and outlet ends connected by a central bore, means for introducing pressurized gas through a gas inlet into the bore between its ends, a nozzle block having a conical entrance located in the bore at the outlet end, and a conically-tipped yarn needle extending into the bore from the yarn inlet end of the body. The yarn needle has a passage therethrough for guiding yarn from the yarn inlet of the body past the gas inlet through the exit end of the needle to the nozzle block. The improvement comprises a high efficiency venturi positioned in the passage of the yarn needle. The venturi may be positioned at the yarn inlet end or the exit end of the passage or at a location intermediate the yarn inlet and the exit end of the passage.

The high efficiency venturi has a flared inlet and a gradually expanding flared outlet connected by a constriction. Maximum efficiency occurs when the gradually expanding flared outlet has an included angle not more than 20° and preferably in the range of from about 6° to about 8°.

DETAILED DESCRIPTION OF THE DRAWING

Figure 1:
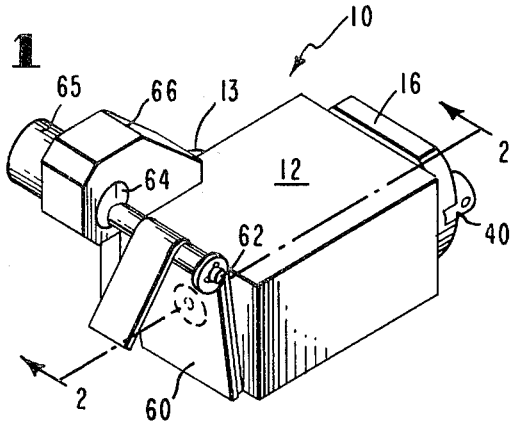
FIG. 1 is a perspective view of a jet incorporating the preferred embodiment of the invention with a baffle fixed with relation to the outlet end of the jet.
Figure 2:
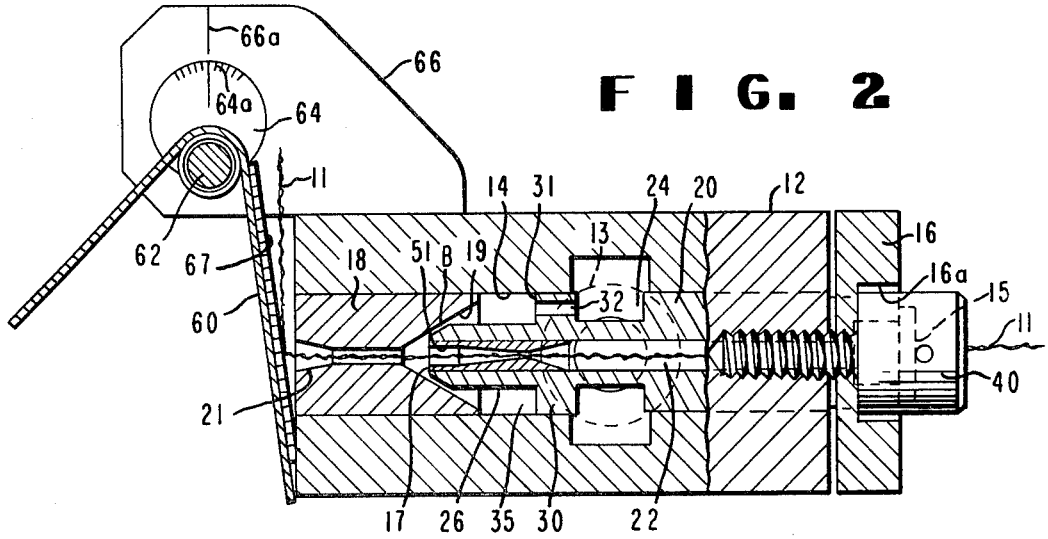
FIG. 2 is an enlarged section of FIG. 1 taken along 2—2.
Figure 3:
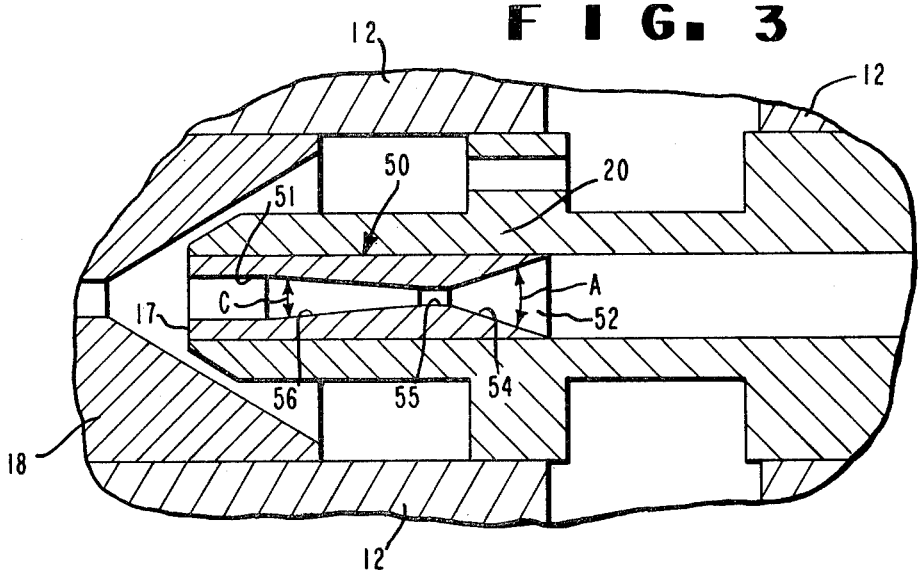
FIG. 3 is an enlarged fragmentary section illustrating the venturi in the yarn needle located near the exit end of the yarn needle.

Referring now to the preferred embodiment illustrated in FIGS. 1–3, the jet 10 includes as components, a body member 12 having a central bore 14, a gas inlet 13 leading into the bore 14 intermediate its ends, a flange 16 located outside the body 12 at the yarn inlet end of the body, a nozzle block 18 located in the bore 14 at the outlet end of the body, and a yarn guiding element (commonly referred to as a yarn needle in the trade) 20 fixed to the flange 16 and having a passage 22 therethrough for guiding yarn 11 from the yarn inlet 15 of the jet past the gas inlet 13 through the flat exit end 17 of the yarn needle to the nozzle block 18. The flange 16 has a counterbored hole **16*a* through one side which is adapted to freely receive bolt 40. Bolt 40 threads into body 12 and abuts against the shoulder of the counterbore of hole 16*a* to serve as a stop for the movement of the yarn guiding element 20 out of bore 14, i.e., serves as a means for limiting movement of the flange 16 away from the inlet end of the body 12. The outer diameter of yarn needle 20 which approximates the inside diameter of bore 14 is reduced in the region opposite the gas inlet 13 which in conjunction with an annular groove in the body 12 at the same location provides an annular plenum chamber 24, following which is a cylindrical portion 30 with an outer diameter approximately equal to the inside diameter of the bore 14 located beyond gas inlet 13. Cylindrical portion 30 has an orifice 32 through it exiting at the surface 31 facing the nozzle block 18. The forward portion 26 of the yarn guiding element 20 consists of another portion of reduced diameter which tapers at an included angle of preferably about 60° to the flat exit end 17. Nozzle block 18 has a converging conical entrance 19 with an included angle of preferably about 60° leading to its exit passage 21 which may be a constant diameter cylindrical bore or preferably may have a short cylindrical portion followed by a conical portion which diverges toward the outlet end of the jet at an included angle of about 7° to form a first venturi. The tapering surface on the end of yarn guiding element 20 and the conical entrance 19 of the nozzle block 18 form an annular restriction between them designated B. Between cylindrical portion 30 and the upstream end of converging conical entrance 19 to nozzle block 18 is an annular chamber 35**.

An insert 50 having a through passage 52 formed in the shape of a high efficiency venturi (i.e., a second venturi) is positioned in the yarn passage 22 near the exit end 17 of the yarn guiding element. The insert 50 is made of highly wear resistant material. As best shown in FIG. 3, the high efficiency venturi passage comprises a flared inlet 54 and a flared outlet 56 connected by a cylindrical restriction 55. The flared outlet 56 gradually expands from the constriction 55 to a cylindrical section 51 of the yarn passage that extends through the flat surface of the exit end 17. The flared inlet as shown has an included angle A of from about 20° to about 30°, however, this is not critical; the requirement being that the boundaries for the flow passage for the yarn and entrained or aspirated air be smooth without abrupt changes in direction. The flared outlet 56 preferably has an included angle C of not more than 20° and preferably in the range of from about 6° to about 8°. When using angles greater than about 20° flow separation from the walls of the flared outlet 56 will occur and this is accompanied by a very large loss in energy with a consequent loss in pulling power for stringup. The ratio of the maximum cross sectional area of flared outlet 56 to the cross sectional area of the constriction 55 is in the range of from about 1.5 to about 16. The larger ratio limit is constrained by the size of the needle tip. The preferred range is from about 3 to about 9.

A baffle is mounted at the outlet end of the jet and is movable about hinge pin 62 according to the teaching of Koslowski, U.S. Pat. No. 3,835,510. Hinge pin 62 is mounted off-center of cylinder 64 which is rotatable in bracket 66 attached to jet body 12. Knob 65 is used to rotate cylinder 64 thus providing an eccentric motion for varying the position of baffle 60 for optimum operating conditions. Index marks **64*a* on cylinder 64 facilitate setting the baffle to optimum operating position. A layer of wear-resistant ceramic material 67 may be attached to the surface of baffle 60** facing the outlet end of the jet.

To string up the jet, yarn 11 is presented to the inlet end 15 of the jet 10. Compressed air is supplied to plenum 24 through inlet 13, then to annular chamber 35 through orifice 32. The flange 16 is moved inwardly away from the head of bolt 40, i.e., from a present operating position to a stringup position so that an aspirating effect draws the yarn 11 through the inlet 15 and out through passage 22. When the yarn emerges from the nozzle block 18, the flange is allowed to return to its preset operating position against bolt 40 under the force of air pressure against yarn guiding element 20 in its reduced region opposite inlet 13.

This texturing jet with a high efficiency venturi located in the yarn passage of the yarn guiding element has been found to have superior stringup capabilities compared to prior art jets. This eases the task of the operators considerably and improves machine yield by reducing downtime because the yarn is more readily picked up and there is less chance of losing a stringup attempt due to wet yarn clinging to the passages of the jets. Moreover, texturing quality is at least equivalent to that experienced with the prior art jets.

Figure 4:
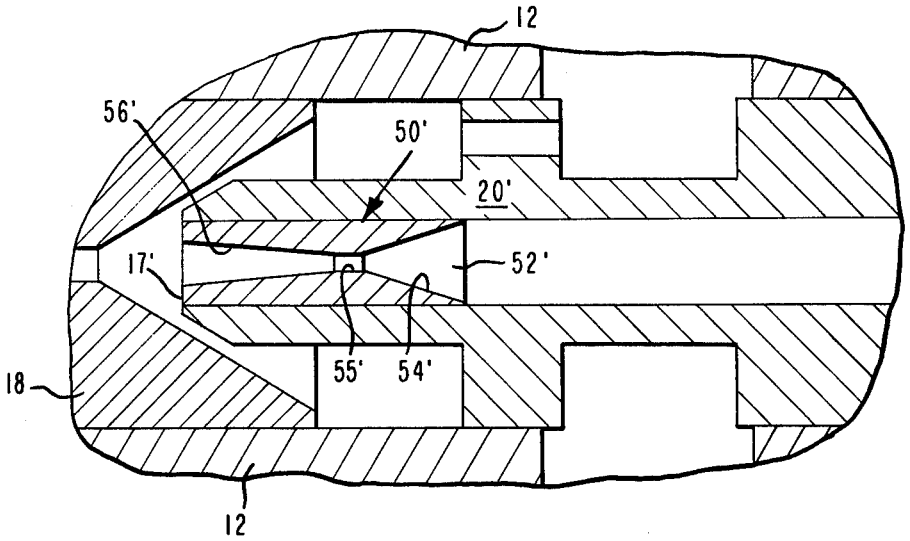
FIG. 4 is a view similar to FIG. 3 illustrating the venturi located at the exit end of the yarn needle.
Figure 5:
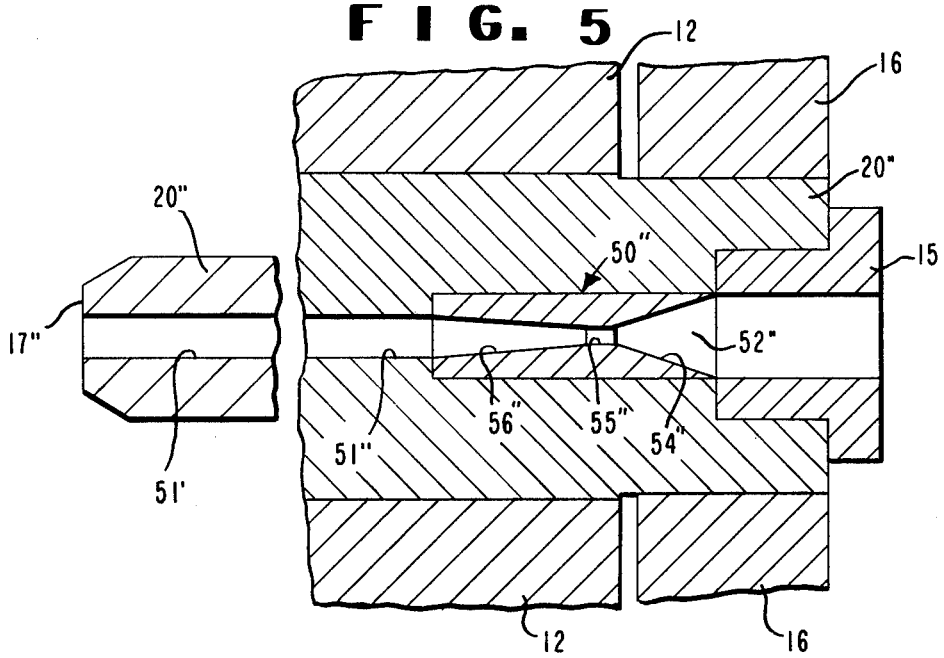
FIG. 5 is another view similar to FIG. 3 illustrating the yarn needle with a venturi located near its entrance end.

While the preferred embodiment illustrates the venturi insert 50 located in passage 22 near the exit end of the yarn guiding element, similar superior stringup capabilities are obtained when the venturi is positioned at other locations in the passage 22. For example, FIG. 4 shows venturi insert 50' located at the exit end of yarn guiding element 20'. More particularly, the gradually expanded flared outlet 56' terminates at flat exit end surface 17'. FIG. 5 shows yet another location for the venturi wherein venturi insert 50'' is located at the entrance end of the yarn guiding element 20''. The flared outlet 56'' gradually expands from the constriction 55'' to a cylindrical section 51'' extending through the exit end 17'' of the yarn guiding element 20''.

While the high efficiency diffuser of this invention has been illustrated using inserts such as 50, 50' and 50'' positioned in the passage of the yarn guiding element, it is to be understood that the functional contour of passage 52 can be an integral part of passage 22 and may be formed by machining, molding, casting or any combination thereof.

We claim:

1. In a yarn texturing jet including a body having yarn inlet and outlet ends connected by a central bore, means for introducing pressurized gas through a gas inlet into said bore between said ends, a nozzle block having a conical entrance located in said bore at said outlet end, and a yarn guiding element sealing off said bore at the yarn inlet end of the body for introducing yarn into said jet, said element having a passage therethrough for guiding yarn from the yarn inlet of the body past the gas inlet through the exit end of said element to the conical entrance of the nozzle block, said element being provided with means for movement toward the conical entrance of the nozzle block for stringup and away from the nozzle block for normal fluid texturing operation, there being a space between said exit end of said element and said conical entrance for throttling the flow of pressurized fluid that flows into said space and out through the nozzle block to create air pressure less than atmospheric at the end of said element, thereby inducing an inward flow of atmospheric air through said passage to draw said yarn through said passage for stringup, the improvement for increasing said inward flow of atmospheric air through said passage to facilitate drawing yarn through said passage during stringup of the yarn comprising: a venturi positioned in said passage, said venturi having a flared inlet and a flared outlet connected by a constriction, said flared outlet being gradually expanded from said constriction to a cylindrical section within said passage and extending through the exit end of said element.

2. The jet as defined in claim 1, said venturi being positioned in said passage near the inlet end of said body.

3. The jet as defined in claim 1, said flared outlet having an included angle of from about 6° to about 8°.

4. The jet as defined in claim 1, said flared outlet having a maximum cross sectional area of from about 3 to about 9 times the cross sectional area of the constriction.

5. In a yarn texturing jet including a body having yarn inlet and outlet ends connected by a central bore, means for introducing pressurized gas through a gas inlet into said bore between said ends, a first venturi located in said bore at said outlet end, and a yarn guiding element sealing off said bore at the yarn inlet end of the body for introducing yarn into said jet, said element having a passage therethrough for guiding yarn from the yarn inlet of the body past the gas inlet through the exit end of said element to the conical entrance of the first venturi, said element being provided with means for movement toward the first venturi for stringup and away from the first venturi for normal fluid texturing operation, there being a space between said exit end of said element and said first venturi for throttling the flow of pressurized fluid that flows into said space and out through the first venturi to create air pressure less than atmospheric at the end of said element, thereby inducing an inward flow of atmospheric air through said passage to draw said yarn through said passage, the improvement for increasing said inward flow of atmospheric air through said passage to facilitate drawing yarn through said passage during stringup of the yarn comprising: a second venturi positioned in said passage, said second venturi having a flared inlet and a flared outlet connected by a constriction, said flared outlet being gradually expanded from said constriction to a cylindrical section within said passage and extending through the exit end of said element.

6. The jet as defined in claim 5, said second venturi being positioned in said passage near the inlet end of said body.

7. The jet as defined in claim 5, said flared outlet having an included angle of from about 6° to about 8°, said flared inlet having an included angle of from about 20° to about 30°.

8. The jet as defined in claim 5, said flared outlet having a maximum cross sectional area of from about three to about nine times greater than the cross sectional area of the constriction.

* * * * *